United States Patent [19]

Fafflok et al.

[11] Patent Number: 4,595,113

[45] Date of Patent: Jun. 17, 1986

[54] DEVICE FOR THE STORAGE AND/OR CARRIAGE OF SENSITIVE MATERIALS

[75] Inventors: Friedrich Fafflok, Paderborn-Neuhaus; Horst Stangl, Altenbeken-schwaney, both of Fed. Rep. of Germany

[73] Assignee: Firma Stangl & Vogt GmbH & Co. KG, Bad Lippspringe, Fed. Rep. of Germany

[21] Appl. No.: 657,251

[22] Filed: Oct. 3, 1984

[30] Foreign Application Priority Data

Oct. 4, 1983 [DE] Fed. Rep. of Germany ... 8328443[U]
May 24, 1984 [DE] Fed. Rep. of Germany ... 8415892[U]

[51] Int. Cl.[4] ..... B65D 21/02

[52] U.S. Cl. ..... 220/23.83; 220/254; 220/256; 220/23.4; 220/412; 220/410

[58] Field of Search ..... 220/23.83, 23.86, 254, 220/256, 22, 23.4, 412, 410

[56] References Cited

U.S. PATENT DOCUMENTS

| | | | |
|---|---|---|---|
| 2,746,634 | 5/1956 | Smith | 220/23.83 |
| 2,799,427 | 7/1957 | Shekter | 220/23.83 |
| 2,944,694 | 7/1960 | Kinsey | 220/23.83 |
| 3,589,554 | 6/1971 | Smith | 220/23.83 |
| 3,613,872 | 10/1971 | Donnelly | 220/412 |
| 3,645,284 | 2/1972 | Krezanoski et al. | 220/23.83 |
| 3,998,351 | 12/1976 | Smith et al. | 220/23.83 |
| 4,162,029 | 7/1979 | Gottsegen et al. | 220/23.83 |

*Primary Examiner*—Joseph Man-Fu Moy
*Attorney, Agent, or Firm*—Marvin E. Jacobs

[57] ABSTRACT

In a device for the storage and/or transport of materials, such as for example temperature-sensitive drugs or the like, an inner container is placed in an outer double walled container and is recessed to form chambers to receive said materials, the openings of which are each provided with an access opening by means of closing discs and the access opening in the upper closing disc is surrounded by a tubular support which acts in association with the stops of the lower closing disc in order to bring the access openings into line.

16 Claims, 14 Drawing Figures

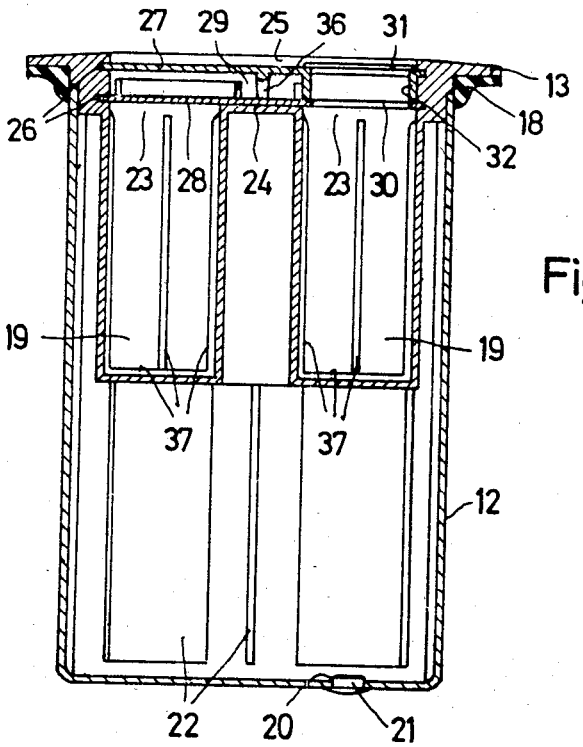
Fig. 2
Fig. 4
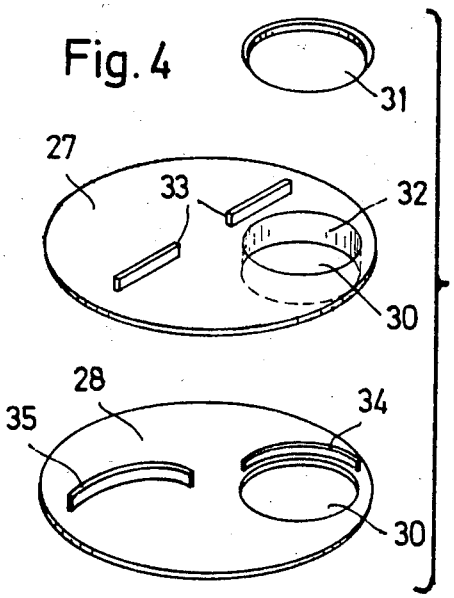
Fig. 3
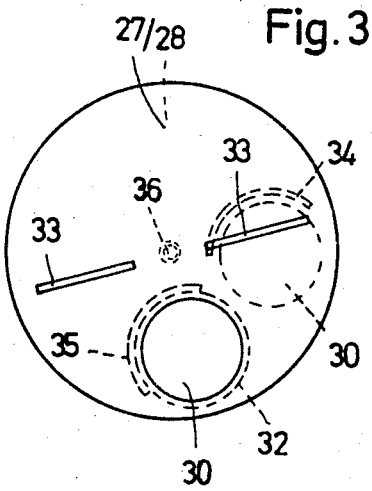

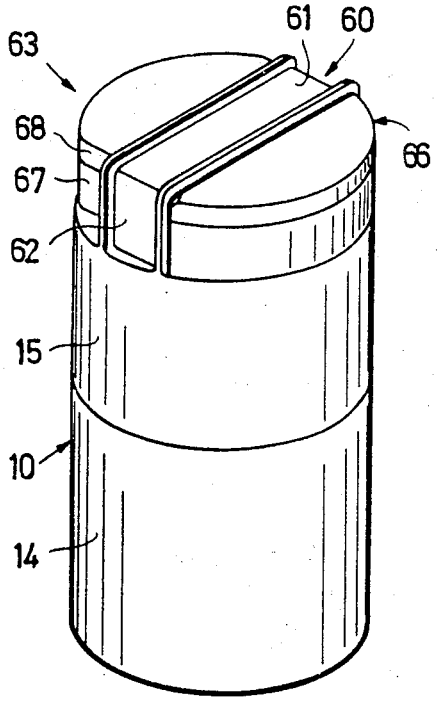
Fig. 8
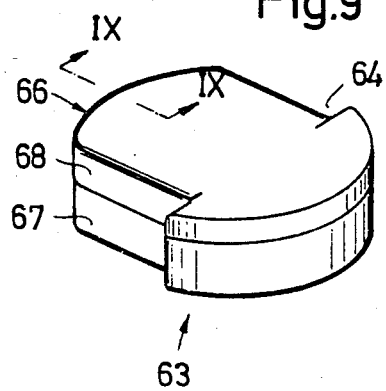
Fig.9
Fig. 10
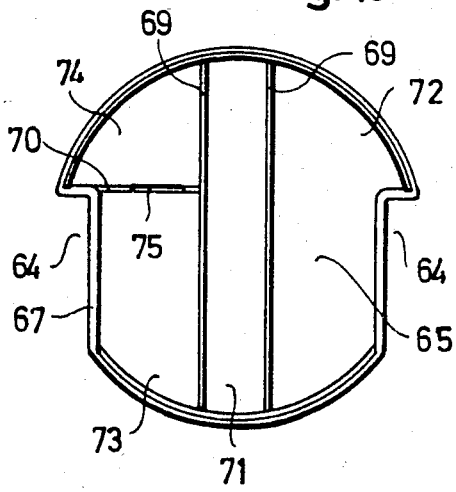
Fig.11
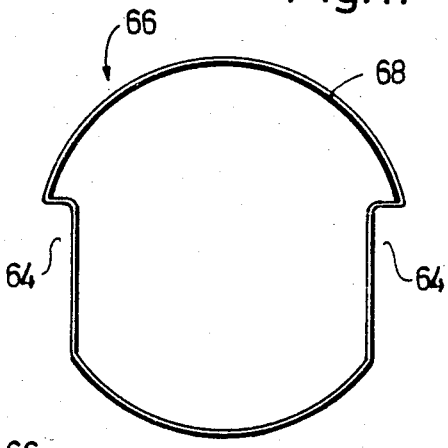
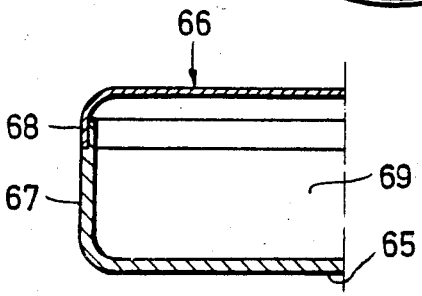
Fig.12

DEVICE FOR THE STORAGE AND/OR CARRIAGE OF SENSITIVE MATERIALS

The invention relates to a device for the storage and/or carriage of solid, liquid or gaseous materials such as for example heat-sensitive or cold-sensitive liquid drugs or the like which are packed in ampoules or the like designed therefor and must be subjected to a specific uniform storage temperature.

BACKGROUND OF THE INVENTION

Drugs or the like materials packed in ampoules or the like have hitherto been transported and stored by the final user in double-walled, jar-shaped, containers having a protective lid which are surrounded by a housing with a screw cap. These devices are known as thermocontainers and they are widely used. These devices are not however suitable for heat-sensitive or cold-sensitive materials because on the one hand their insulation is inadequate and on the other hand all the other ampoules within the container are subjected to heat exchange when the container is opened.

The object of the invention is to improve a device of this type so as to permit the prolonged storage of sensitive materials and individual removal of the material. In addition, the simply constructed device must be easy to transport and easy to maintain. Further, the device must permit an attachment for the removal of ampoules to be inserted and an additional container to be secured to it.

SUMMARY OF THE INVENTION

This object is achieved in accordance with the invention by placing an inner container, which is fitted with chambers to take the material, the openings thereof being covered by means of closing discs at a distance from each other and each provided with access openings, within an outer container.

The openings thus covered by means of closing discs can be made ready for removal of the material by simple rotation of the upper closing disc so that its access opening is above the opening to a chamber while the other chambers remain covered.

The closing discs are preferably rotatably mounted in an annular space in annular grooves in the upper part of the chamber, the upper closing disc being at a distance from the lower closing disc thus forming an air space, and the air space between the closing discs being bridged by means of a tubular support surrounding the access openings and attached to the upper closing disc which acts to align the lower access opening with stops on the lower closing disc.

It is also preferred that the covering lid of the housing should be provided with a clip into which a cylinder-shaped tube portion can be inserted. This tube portion is provided on one side with elastic tongues which grip the top of an ampoule which is stored in the container and can be removed. A channel-shaped gripping member into which a hypodermic needle can be inserted is attached to the end of the tube portion opposite to the tongues.

In another preferred embodiment of the invention, an additional small container, which is held by means of a U-shaped handle in the closing cap is located against the upper side of the closing cap constructed as a covering lid.

Where necessary this additional container can thus be removed from the U-shaped handle and the intermediate space formed at the front and be filled with material from the main container so that it is possible to move this away from the main container for a certain period. If the material, e.g. an ampoule of drugs, placed in the additional container is not required it can be pushed back into the main container when it is returned to it and subjected to the desired temperature conditions.

Further preferred embodiments of the invention are included in the subsidiary claims. The scope of the invention extends not only to the characteristics claimed individually but also to their combinations.

Devices constructed in this way are easy to handle and can be constructed simply; they provide a high degree of insulation and ensure that the chambers are closed individually thus ensuring a long storage life for the sensitive material.

BRIEF DESCRIPTION OF THE DRAWINGS

FIG. 2 shows a vertical section through the inner container with the chambers for the material and the closing discs;

FIG. 3 shows a plan view of the superimposed closing discs;

FIG. 4 shows a perspective view of the closing discs with access openings;

FIG. 8 shows a perspective view of the container according to the invention with an additional container;

FIG. 9 shows a perspective view of the additional container;

FIG. 10 shows a perspective view of the base portion of the additional container;

FIG. 11 shows a perspective view of the cover of the additional container; and FIG. 12 shows a vertical section through the additional container taken along the line IX—IX of FIG. 9.

DETAILED DESCRIPTION OF PREFERRED EMBODIMENT

Figure 1:
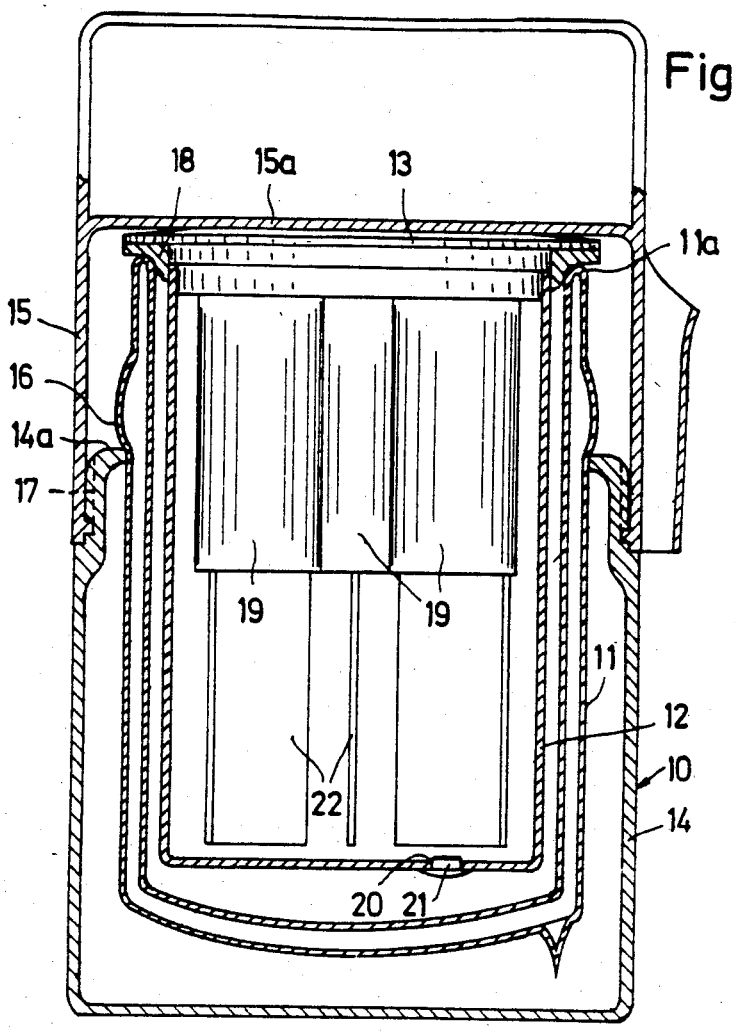
FIG. 1 shows a container in partial vertical cross-section.

A device 10 for the storage and/or carriage of materials (such as a cold-sensitive or heat-sensitive drugs or the like) comprises an outer, jar-shaped, container 11 preferably of doublewalled glass, plastics or the like material. The upper edge 11*a* of outer container 11 supports an inner container 12 by its externally directed horizontal flange 13. Outer container 11 is enclosed by a jar-shaped housing 14 which is covered by means of an unscrewable covering lid 15. The outer container 11 is supported on upper edge 14*a* of housing 14, which is made for example of plastics material, by means of a protruberance 16.

When covering lid 15 is screwed onto housing 14 by means of a thread 17, the cover wall 15*a* of covering lid 15 presses against flange 13 of inner container 12, which in turn presses against edge 11*a* of outer container 11, and this in turn presses by means of protruberance 16 against edge 14*a* of housing 14 so that both containers 11 and 12 are locked together with housing 14.

An elastic seal 18 of rubber or the like is preferably inserted between flange 13 and edge 11*a* and seals the inner container 12 against the outer container 11 and also holds the inner container 12 elastically.

Several cylindrically-shaped chambers 19 arranged in a circle at a distance from the container wall project into the inner container 12 inside flange 13. This outer jar-shaped container 11 which is made for example of plastics material is attached to flange 13 by means of adhesive, welding or the like and its base can be filled with cooling fluid or the like by means of a filling hole 20 which is sealed by means of a stopper 21.

The chambers projecting into inner container 12 are each provided at the base with a vane 22 which extends almost as far as the filling hole 20 and dampens the movement of the cooling fluid in the course of transport and is also able to guide the cooling fluid uniformly around chambers 19.

At the top, the chambers 19 each have an opening 23 for insertion or removal of material, the upper wall 24 of which forming openings 23 is turned back from the upper edge of the flange and forms an annular space 25. Annular grooves 26, in which an upper closing disc 27 and a lower closing disc 28 are set rotatably one above the other, are located in the vertical wall of the annular space 25. Closing discs 27 and 28 are at a distance from each other forming an air space 29 therebetween and are each provided with an access opening 30.

Access opening 30 of the upper closing disc 27 can be closed by means of a cover 31 and is enclosed by means of a tubular support 32 extending vertically downwards from its underside. The lower annular surface of tubular support 32 lies against the upper surface of lower closing disc 28 and seals off air space 29. Upper closing disc 27 is provided with two gripping members 33 on its upper surface so that it can be rotated.

The upper surface of lower closing disc 28 is provided with two stops 34, 35 which act together as an engaging member of lower closing disc 28 with tubular support 32 when upper closing disc 27 is rotated. Stops 34, 35 are formed as projections, stop 34 being placed at a distance around and partly surrounding access opening 30 in order to ensure unimpeded access to chamber 19. Stop 35 is placed at a distance from stop 34 according to the distance between chambers 19 placed in a circle so that access opening 30 comes into line with openings 23 of chambers 19 by engaging lower closing disc 28. Rotation towards the right or the left is the same so that only one opening 23 is uncovered. Catches or the like (not illustrated) which correspond to the layout or arrangement of chambers 19 and ensure accurate positioning of closing discs 27, 28 with openings 23 may be provided on the surface of lower closing disc 28 directed towards wall 24 for the better marking of openings 23, 30. A catch 36 or the like is located centrally on the underside of closing disc 27 and rests against lower closing disc 28 and is pressed against wall 24 so that here again they are in tight contact.

In order that the material located in chambers 19 should be kept as far as possible from the walls and so as to achieve no contact, or as little contact as possible, between the material and chambers 19, several spaced ribs 37, projections or the like are placed on the walls of chamber 19 and extend to the base thereof, running longitudinally or at right angles thereto.

A device 10 constructed in this way has a variety of uses. By virtue of the fact that chambers 19 are sealed and can be opened individually it may be used to store and transport other materials such as readily volatile substances or the like.

Closing discs 27, 28 located in annular space 25 may be increased in number. Thus for example a further closing disc which is likewise provided with an access opening 30 and an engaging member, e.g. tubular support 32, may be rotatably mounted in the annular space above closing disc 27. Closing disc 27 then has the same stops 34, 35 on its upper surface as lower closing disc 28.

Figure 4A:
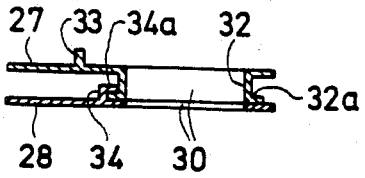
FIG. 4*a* shows a vertical section through the closing discs with angled stops.

Stops 34, 35 of closing disc 28 may for example, as illustrated in FIG. 4*a*, be of angular construction, their flanges 34*a* being parallel to the upper surface of the closing disc. Likewise tubular supports 32 of closing disc 27 directed towards closing disc 28 may be provided with an outwardly directed shoulder 32*a* which engages horizontal flanges 34*a*, 35*a* of stops 34, 35 from beneath when closing disc 27 is rotated and prevents unintentional lifting of tubular support 32 from the surface of closing disc 28.

Figure 2A:
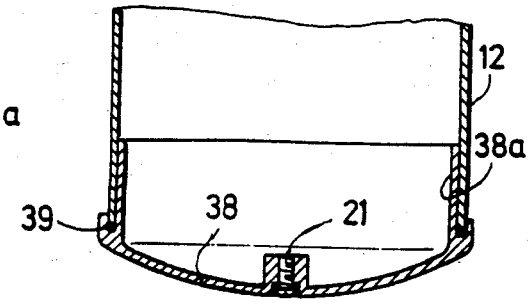
FIG. 2*a* shows a vertical section through the same container with a specially secured convex base.

The shaped base of container 12 with stopper 21 according to FIG. 2*a* may for example be constructed from a separate disc 38 with a surrounding shoulder 38*a*. Disc 38 then matches the base of outer container 11 with corresponding convexity and ends in a peripheral groove 39 opposite shoulder 38*a*. Cylindrical inner container wall 12 then fits over shoulder 38*a* and can be inserted into the groove after adhesive has previously been applied to the groove area.

Figure 5:
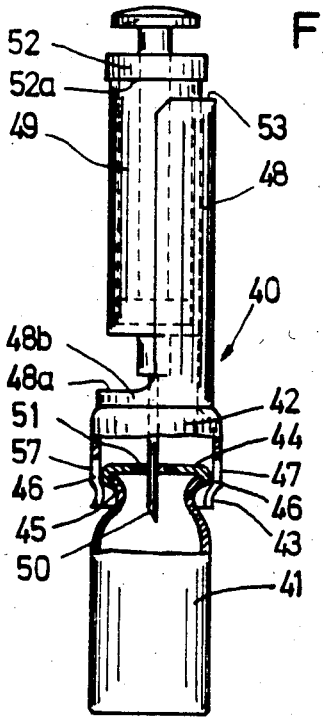
FIG. 5 shows a side view of the gripping device with an ampoule held between the tongues and a hypodermic needle (partly shown) in the gripping member.
Figure 6:
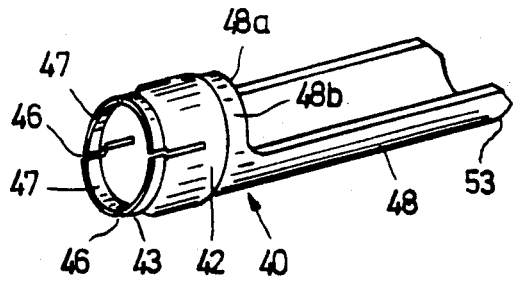
FIG. 6 shows a perspective view of the device.
Figure 7:
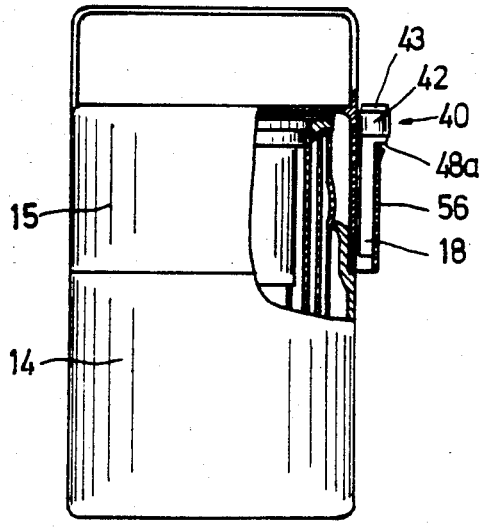
FIG. 7 shows a side view of the carrying and storage container with a device (partly shown) inserted into a clip.

FIGS. 5–7 illustrate a device 40 for gripping bottle-like ampoules 41 or the like which for example lie awaiting removal in chambers provided for the purpose in a carrying container. This comprises a cylindrical tubular portion 42, the bottom end of which is able to surround ampoule 41, and a collar 43 which has a diminishing diameter above the top 45 of the bottle closed by a covering seal 44 and holds it securely. The internal diameter of collar 43 is made slightly smaller than the external diameter of the top 45 of the bottle with covering seal 44.

In order to accommodate possible differences in diameter between collar 43 and the top 45 of the bottle, the collar 43 is divided up by several peripheral slots 46 which extend almost half the length of tubular portion 42 and divide tubular portion 42 into individual tongues 47. Tongues 47 are elastic and move apart correspondingly when divided collar 43 engages behind bottle top 45.

A gripping member 48, which has the shape of a semicircular tube in cross-section (half-shell), is formed in the end of tubular portion 42 opposite tongues 47 and forms a gripping extension to grip a bottle-shaped ampoule 41 placed in a deep chamber 19. If an ampoule 41 is gripped by tongues 47, a hypodermic syringe 49 with a needle 50 can be placed in gripping member 48 and can then be pushed in the direction of ampoule 41. During this movement needle 50 presses against a soft portion 51 in covering seal 44 of ampoule 41 which is provided for the purpose, until the tip of needle 50 reaches the interior of ampoule 41. The movement of the hypodermic syringe 49 is limited by its terminal screw cap 52, the edge 52*a* of which lies against front surface 53 of gripping member 48 when needle 50 reaches a sufficient depth inside ampoule 41. The longitudinal axis of hypodermic syringe 49 is then in line with the longitudinal axis of ampoule 41.

The position of the hypodermic syringe 49 in gripping member 48 can also be determined by a stop edge 48*a* which is attached to the half-shell of gripping member 48 as an annular member 48*b* on tubular portion 42.

The, for example, semicircularly shaped gripping member 48 can be inserted simply into a clip 56 or the like in cover 15 of carrying and storage housing 14 so that it can be carried with it. In this way, tubular portion 42 which grips ampoule 41 is directed upwards, stop surface 48*a* being supported against the edge of clip 56 and thus being prevented from slipping through clip 56.

A device constructed in this way can easily be made in one piece as an injection moulded plastics member and may be provided as an accessory for a carrying and storage housing 14 which contains bottle-shaped ampoules.

FIGS. 8–10 illustrate a device 10 for the storage or carriage of materials which are sensitive to heat or cold, which comprises a lower jar-shaped housing 14 and a closing cap screwed thereon to form a covering lid 15 which has the same circular cross-section as housing 14. The upper end of lid 15 is provided with a U-shaped handle 60, the U-shaped limb 61 of which extends parallel to the diameter of lid 15, while the vertical limbs 62 of the U are secured to lid 15 at their lower ends. Lid 15, in the form of a covering cap, and handle 60 may be constructed as a single plastics member.

An additional flat container 63, having the same circular cross-section as lid 15, but with two recesses 64 at the sides, each recess 64 being constructed to correspond to the spatial dimensions of U-shaped handle 62, may be inserted into the intermediate space between the front upper space of lid 15 and U-shaped handle 60. The parallel boundary walls with recesses 64 thus form so-to-speak a section cut out of the circular surfaces of additional container 63. The additional container is constructed from a container bottom 65, a container lid 66 of corresponding shape, a bottom wall extending in a peripheral direction at right angles to the bottom and a corresponding lid wall 68 formed on lid 66. Lid wall 68 of container lid 66 thus lies against bottom wall 67 of container bottom 65 so that additional container 63 is closed.

The internal space in additional container 63 is divided up into several sections by means of partition walls 69 and 70 at right angles to the base of the container. Two identical partition walls 69 run parallel to the main sides of the linear parts of bottom wall 67 forming recesses 64 and form a compartment 71 for a hypodermic needle in the centre of container bottom 65. A compartment 72, which is for example for solid material such as packed sugar, is formed by a partition wall 69 and bottom wall 67 while the corresponding compartment on the other side of container bottom 65 is divided for example into a compartment 73 for an ampoule of drugs and a compartment 74 for an alcohol swab by partition wall 70 at right angles to the other partition wall 69. Partition wall 70 incorporates a groove 75 by means of which the ampoule is supported axially at one end so that it takes up a secure position in additional container 63.

Bottom wall 67, which extends at right angles, may be fitted between side arms of U-shaped handle 62 the attaching limb of U-shaped handle 62 being located at a distance from container lid 66 to provide a grip for a finger. Furthermore catches, mouldings and the like may be provided in wall 67 in order that additional container 63 is held firmly between the vertical limbs of U-shaped handle 62.

We claim:

1. A device for the storage and/or carriage of materials, which device is formed from an outer, double-walled, jar-shaped, container having a protective cover and is enclosed by a housing having a screwable lid, wherein an inner container enclosed by the outer container is provided with chambers separated from one another which carry the material, the openings of said chambers being covered by means of superimposed closing discs at a distance from one another and provided with access openings.

2. A device as recited in claim 1, wherein the chambers projecting into the inner container are provided at the top with an outward horizontal flange which is supported on the upper edge of the outer container and the chamber opening of the upper flange edge is deeper set forming an annular space in which the closing discs are housed, the closing discs being held at a distance from one another in annular grooves forming an air space.

3. A device as recited in claim 2, wherein the stops of the lower closing disc are formed from mouldings which partly surround the tubular support and are separated by a distance which corresponds to the distance between the chambers which are arranged in a circle and the lower front edge of the tubular support lies against the surface of the lower closing disc and forms a sealing surface.

4. A device as recited in claim 3, wherein the access opening in the upper closing disc is covered with a removable cover and the closing disc is provided on its upper surface with a grip for rotation.

5. A device as recited in claim 4, wherein the chambers holding the material are provided on their inner walls with projections and catches and wherein a projection projecting into the inner container is placed beneath the base of each chamber.

6. A device as recited in claim 5, wherein the inner container has a filling hole in its base which can be sealed by a stopper, the inner container with chambers being constructed of plastics material and lying in an outer double walled container of glass which is surrounded by the housing having an upper unscrewable lid.

7. A device as recited in claim 6, wherein an additional closing disc with a means of engagement is provided above the closing disc, this means of engagement on the upper side of the closing disc working in association with the stops intended to engage all the closing discs.

8. A device as recited in claim 1, wherein a tubular portion which is provided with an elastic tongue to grip the top of the bottle at one end and a channel-shaped gripping member with a space to take a hypodermic syringe at its other end can be inserted into a clip preferably located in the lid of the container.

9. A device as recited in claim 8, wherein the tubular member is provided with a collar with a diminishing diameter on the side facing the top of thebottle which grips the top of the bottle from behind, this collar being provided with slots which extend almost half the length of the wall of the tubular portion forming tongues, wherein the longitudinal axis of the receiving space forms an extension to the longitudinal axis of the tubular portion.

10. A device as recited in claim 9, wherein the front end of the gripping member forms a stop surface for an outer edge of the screw cap of the hypodermic syringe and the gripping member is in the shape of a half shell.

11. A device as recited in claim 10, wherein the tubular member forms a stop surface limiting the depth of penetration of the needle of the hypodermic syringe, the tubular portion is constructed as a supporting surface for the gripping member which is to be inserted into a clip of a carrying container, wherein the gripping member and the tubular member provided with tongues are made in one piece from plastics material.

12. A device as recited in claim 1, wherein an additional container is placed on the front upper side of the lid (closing cap), this container being held by a U-shaped handle on the lid, having a circular cylindrical shape and the U-limb of the handle extending parallel to a diameter of the lid.

13. A device as recited in claim 12, wherein the two U-limbs of the handle are secured on the perimeter of the lid and run parallel to its cylindrical axis, the additional container being formed from a container bottom, a ccrresponding container lid and encircling walls at right angles thereto which can be clipped together.

14. A device as recited in claim 13, wherein the container bottom and the container lid of the additional container each have a circular shape corresponding to the cross-section of the lid which is diminished by two recesses corresponding to the spatial dimensions of the U-limb of the handle and wherein the internal space of the additional container is divided up into several different compartments to receive objects by means of partition walls formed at right angles to the bottom of the container.

15. A device as recited in claim 14, wherein the additional container is firmly held close fitted between the vertical limbs of the handle and/or catches, mouldings or the like which releasably hold the container inside the handle are made in the walls of the container.

16. A device as recited in claim 15, wherein the bottom of the container having a stopper is formed in the shape of a separate convex disc which is provided at the edge with a shoulder at right angles thereto by which it engages the container wall, the front edge thereof being inserted and bonded by adhesive into a peripheral groove in the disc.

* * * * *